United States Patent [19]

Favot et al.

[11] 4,393,678

[45] Jul. 19, 1983

[54] SPRING COILING MACHINE

[75] Inventors: Guido Favot; Alf A. Berg, both of Västeras, Sweden

[73] Assignee: Tekno-Detaljer Sture Carlsson AB, Vallingby, Sweden

[21] Appl. No.: 218,795

[22] Filed: Dec. 22, 1980

[51] Int. Cl.[3] ..... B21F 3/02; B21F 11/00

[52] U.S. Cl. ..... 72/131; 72/132; 72/138

[58] Field of Search ..... 72/131, 132, 135, 138, 72/139, 142, 143, 144, 145, 451, 452

[56] References Cited

U.S. PATENT DOCUMENTS

| | | | |
|---|---|---|---|
| 1,836,763 | 12/1931 | Liebergeld | 72/451 X |
| 2,119,002 | 5/1938 | Bergevin et al. | 72/145 X |
| 3,192,748 | 7/1965 | Lange | 72/138 X |
| 3,402,584 | 7/1965 | Cavagnero | 72/137 |

FOREIGN PATENT DOCUMENTS

| | | |
|---|---|---|
| 2108940 | 8/1972 | Fed. Rep. of Germany . |
| 2409690 | 9/1975 | Fed. Rep. of Germany . |
| 330676 | 11/1970 | Sweden . |

*Primary Examiner*—Ervin M. Combs
*Attorney, Agent, or Firm*—Fleit, Jacobson & Cohn

[57] ABSTRACT

A spring coiling machine comprises two cooperating rotatable wire feeding rollers and a driving device for said wire feeding rollers by which said rollers may be rotated in order to feed a wire in its longitudinal direction between said rollers to a spring forming station, where wire bending tools are provided to cause the wire, as it reaches said station, to be successively bent into a generally helical shape in order to form a coiled spring by being brought into contact with said bending tools with successive portions thereof, and where a separate movable pitch controlling tool is provided to control the pitch of said spring along the length thereof through engagement with said wire. A cam follower is connected to said pitch controlling tool to control the position thereof through cooperation with a movable cam curve operatively connected to said driving device. Said cam curve is arranged for reciprocating rectilinear movement in unison with a reciprocating gear rack included in said driving device.

10 Claims, 5 Drawing Figures

SPRING COILING MACHINE

The present invention relates to a spring coiling machine, i.e. to a machine for use in the production of coiled springs.

More particularly, the invention relates to a spring coiling machine of the kind comprising two cooperating rotatable wire feeding rollers, a driving device for said wire feeding rollers by which said rollers may be rotated in order to feed a wire in its longitudinal direction between said rollers to a spring forming station, where wire bending tools are provided to cause the wire, as it reaches said station, to be successively bent so as to form a coiled spring by being brought into contact with said bending tools with successive portions thereof, and where a separate movable pitch controlling tool is provided to control the pitch of said spring along the length thereof through engagement with said wire, a cam follower being connected to said pitch controlling tool to control the position thereof through cooperation with a movable cam curve operatively connected to said driving device.

In prior art machines of said kind, rotatable cam curves have been utilized for controlling the position of the pitch controlling tool. In practice, it has however been found that it may be extremely difficult to control the position of said tool in an appropriate and exact manner by means of a rotatable cam curve.

Therefore, the invention has for its object to provide an improved spring coiling machine of the kind initially specified which obviates the above disadvantage of the prior art machines.

In accordance with the invention, for this purpose there is proposed a spring coiling machine of said kind, wherein said cam curve is arranged for reciprocating rectilinear movement in unison with a reciprocating gear rack included in said driving device.

Other objects and features of the invention will appear from the following detailed description, in which the invention will be explained in further detail, reference being had to the accompanying diagrammatic drawings, in which.

Figure 1:
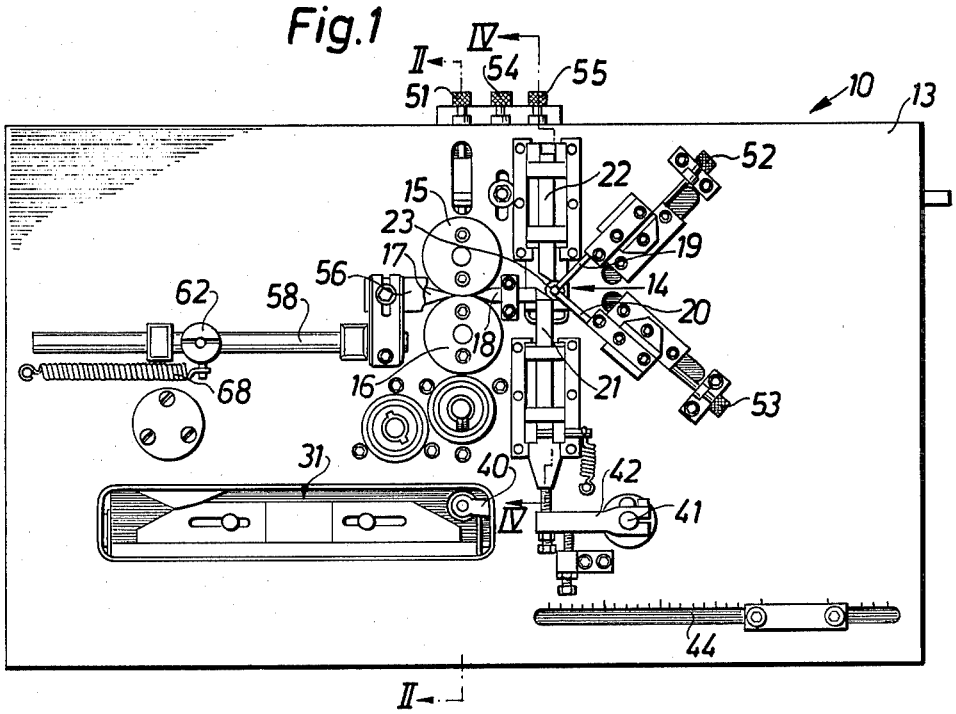
FIG. 1 is a front view of a spring coiling machine according to an embodiment of the invention, selected by way of example.
Figure 2:
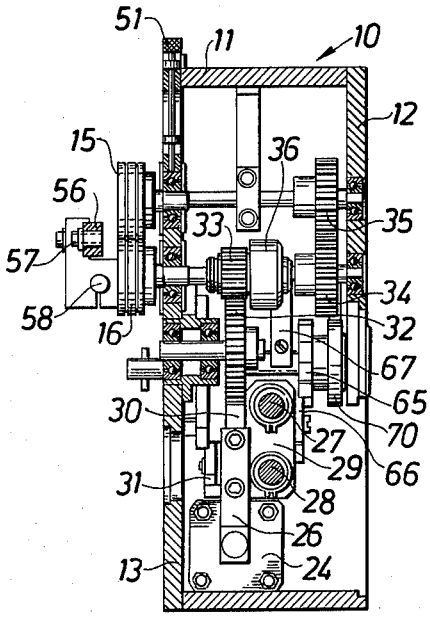
FIG. 2 is a side elevation, in cross-section, taken along line II—II in FIG. 1.

The illustrated machine has a casing, generally designated 10, which comprises side walls 11, a rear wall 12 and a front wall 13.

Reference numeral 14 generally designates a spring forming station, to which a wire, intended to be formed into a coiled spring, may be fed in its longitudinal direction by means of two cooperating wire feeding rollers 15 and 16 which are arranged to feed said wire between the same. Guides 17 and 18, through which the wire may pass freely, are provided before and after the two rollers 15 and 16 which are arranged to be forced resiliently against each other with their outer surfaces. The magnitude of the spring force may be adjusted by means of a set screw 51.

At the spring forming station 14, bending tools are provided for successively bending the wire into a helical shape in order to form a coiled spring therefrom. Said bending tools are formed by two rods 19 and 20, having end surfaces located at station 14 and adapted to cooperate with the wire to give it the desired curvature. Rods 19 and 20 are displaceable in their longitudinal directions by means of set screws 52 and 53, respectively. Hereby, the positions of said rods may be adjusted to correspond to the desired diameter of the springs to be formed at station 14. Reference numeral 21 designates a pitch controlling tool by which the pitch of a spring produced at station 14 may be varied along its length. Said tool 21 has a wedge-shaped tip by which it may be brought into variable engagement with the wire. Tool 21 is mounted for vertical displacement on the front wall 13 of casing 10, below spring forming station 14. At station 14, there is also provided a cutting tool 22, which is mounted for vertical displacement above said station and which is arranged to separate a finished spring from the remainder of the wire through cooperation with a pin 23 located centrally at station 14 and projecting from the front wall 13 of casing 10. Said cutting tool 22 may be adjusted by means of a set screw 54, while pin 23 may be adjusted by means of a set screw 55.

Figure 3:
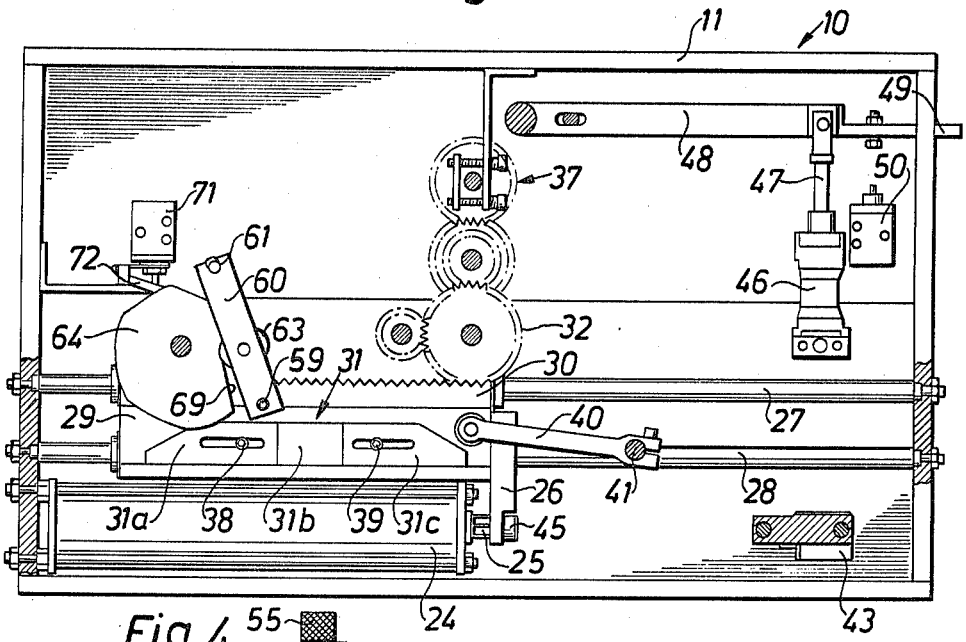
FIG. 3 is a front elevation of the machine of FIG. 1, showing the machine upon removal of its front wall and various parts mounted on said wall.
Figure 4:
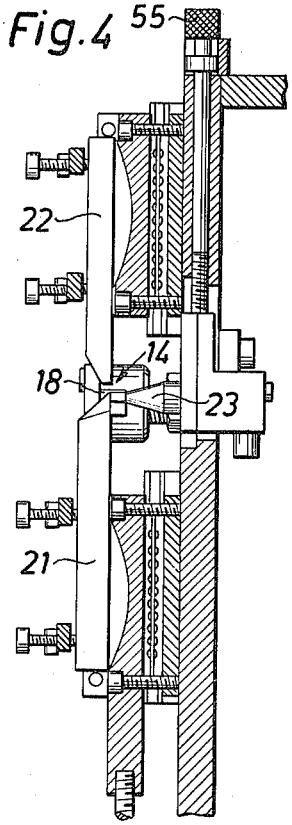
FIG. 4 is a partial side elevation, on an enlarged scale and in cross-section, taken along line IV—IV in FIG. 1.
Figure 5:
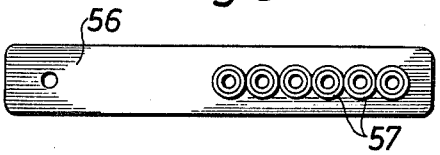
FIG. 5 is a front view, on an enlarged scale, of a distributor of the machine serving to facilitate a distribution of the springs produced to different usage stations.

The primary driving means for the wire feeding rollers 15 and 16 is formed by a pressure fluid operated working cylinder 24 which preferably may be pneumatically operated. Via an arm 26, the piston rod 25 of cylinder 24 is connected to a slide 29 displaceably mounted on two parallel guide rods 27 and 28. Slide 29 serves as a carrier for a gear rack 30 extending in the longitudinal direction of slide 29 and a cam curve 31 also extending in said direction. Gear rack 30 is connected to wire feeding rollers 15 and 16 over a transmission comprising two pairs of intermeshing gear wheels 32, 33 and 34, 35, respectively, and a one-way coupling 36. Hereby, gear rack 30 may rotate the two wire feeding rollers 15 and 16 in opposite directions in order to feed a predetermined length of wire to spring forming station 14, when the piston of cyliner 24 carries out a working stroke, i.e. when piston rod 25 moves to the right in FIGS 1 and 3. During the subsequent return stroke of the piston of cylinder 24, the wire feeding rollers 15 and 16 will be stationary due to the function of coupling 36 and as a consequence of braking action applied on said rollers from a brake 37.

Cam curve 31 consists of three portions 31*a*, 31*b* and 31*c* which are displaceable with respect to each other in the longitudinal direction of slide 29 and which may be locked in adjusted positions by means of locking screws 38 and 39. In the illustrated embodiment, cam curve 31 has a straight horizontally extending camming surface along a major portion thereof. However, at the outer ends of portions 31*a* and 31*c*, it has inclined camming surfaces. Cam curve 31 serves to control the position of the pitch controlling tool 21 and hence, the pitch of a spring produced in the machine along the length of said spring. For this purpose, a cam follower 40 is provided to sense the camming surface of cam curve 31 and to operate tool 21 over a shaft 41 and an arm 42. When cam curve 31 is shaped as illustrated, a spring produced in the machine will have a constant pitch along a major portion of its length. However, the wire turns at the ends of the spring will be located close to each other.

Reference numeral 43 designates a valve which serves as an adjustable limit switch and which is displaceably mounted in a longitudinally extending slot-shaped opening 44 in front wall 13 to permit an adjustment of the stroke of the piston of cylinder 24 and, hence, of the length of wire fed to station 14 during each working stroke of said piston. When actuated by an armature 45 mounted on the outer end of piston rod 25, valve 43 will interrupt the supply of pressure fluid to working cylinder 24 and stop the movement of slide 29, gear rack 30 and cam curve 31. Simultaneously, valve 43 will cause an actuation of an operation cylinder 46 for cutting tool 22 causing said tool to carry out a cutting operation. The piston rod 47 of cylinder 46 is connected to cutting tool 22 by means of an operating lever 48 having an end portion 49 which projects outside casing 10 to permit manual operation thereof. At the end of or upon the completion of a cutting operation, operating lever 48 will actuate a further valve 50 which then initiates a return stroke of the piston of working cylinder 24 and of slide 29, gear rack 30 and cam curve 31.

The illustrated machine is also provided with a distributor for the springs produced, said distributor serving to facilitate a distribution of the springs to different usage stations.

Said distributor comprises a horizontal bar 56 of rectangular cross-section, which is provided with a row of through bores in which bushings 57 are mounted. Said bushings form reception chambers for the springs produced at the spring forming station. From said chambers, the springs may be fed to desired usage stations through hoses threaded on the front ends of bushings 57.

Said bushings 57, which are spaced apart from each other in the longitudinal direction of bar 56, are arranged to be positioned sequentially one upon the other in front of spring forming station 14 to receive the springs there produced in the successive reception chambers formed by said bushings. In order to ensure that each spring produced at station 14 will be properly fed into a bushing 57 located in front of said station, the machine may be provided with means for ejecting a flow of pressurized air in the longitudinal direction of pin 23 in connection with the separation of a finished spring from the continuous wire fed to station 14.

The distributor bar 56 is mounted on a rod 58 which, in its turn, is displaceably mounted on the front wall 13 of casing 10 and which is adapted, during each return stroke of the piston of working cylinder 24, to rectilinearly move bar 56 to the right, as seen in FIG. 1, a distance corresponding to the spacing between bushing 57. For this purpose, rod 58 is connected to a drive comprising a lever 60, at its one end pivotally mounted on a pin 59 and at its other end connected to rod 58 by means of a pin 61 and a head 62, mounted on said pin 61. At a position between its two ends, lever 60 is provided with a cam roller 63 which cooperates with a camming surface of a cam disk 64. Said cam disk is connected to a ratchet wheel 65 which serves to rotate cam disk 64 one step for each return stroke of the piston of working cylinder 24. The stepwise rotation of cam disk 64 is obtained by means of a pawl 66 mounted on slide 29 and adapted to engage with ratchet wheel 65. Reference numeral 67 designates a brake which serves to maintain cam disk 64 in its position set. As can be seen from FIG. 3, in the illustrated embodiment, the cam surface of cam disk 64 comprises six segments, each corresponding to one bushing 57 in distributor bar 56. When the leftmost bushing 57 has reached spring forming station 14 and the piston of cylinder 24 is then caused to carry out a return stroke (upon a preceding working stroke), the distributor bar 56 and the carrier for said bar, formed by rod 58, will be returned to the position shown in FIG. 1 through the action of a spring 68. This return movement takes place as cam roller 63 reaches a steep portion 69 of the camming surface of cam disk 64. In order to stop the machine automatically when a number of springs have been produced corresponding to the number of bushings 57 in distributor bar 56, i.e. when bar 56 and rod 58 have been returned to their starting positions by spring 68, a cam disk 70 is provided, which is connected to cam disk 64 and ratchet wheel 65 and which cooperates with a valve 71, serving to interrupt the operation of the machine when actuated by cam disk 70 via a cam follower formed by a lever 72. The machine must then be started again to initiate the production of a new set of springs and to discharge said springs to the successive transport hoses connected to the distributor. Valve 71 may suitably be arranged to permit bridging the same when it is desired to have the machine to operate in a continuous manner.

The invention is not restricted to the embodiment above described and shown in the drawings. Instead, many modifications are feasible within the scope of the invention. For instance, the primary driving means of the machine need not consist of a pressure fluid controlled working cylinder. Instead, said driving means may be formed by a driving motor of any suitable kind which is adapted to cause the desired reciprocating movement of gear rack 30 and cam curve 31.

We claim:

1. A spring coiling machine, comprising two cooperating rotatable wire feeding rollers and a driving device for said wire feeding rollers by which said rollers may be rotated in order to feed a wire in its longitudinal direction between said rollers to a spring forming station, where wire bending tools are provided to cause the wire, as it reaches said station, to be successively bent so as to form a coiled spring by being brought into contact with said bending tools with successive portions thereof, and where a separate movable pitch controlling tool is provided to control the pitch of said spring along the length thereof through engagement with said wire, a cam follower being connected to said pitch controlling tool to control the position thereof through cooperation with a movable cam curve operatively connected to said driving device, wherein said cam curve defined by a plurality of distinct portions which are longitudinally displaceable relative to each other, said cam curve being mounted for reciprocating rectilinear movement in unison with a reciprocating gear rack included in said driving device.

2. A spring coiling machine according to claim 1, wherein said gear rack and said cam curve are mounted on a common slidable carrier.

3. A spring coiling machine according to claim 1, wherein said gear rack and said cam curve are adapted to be driven from a pressure fluid operated working cylinder.

4. A spring coiling machine according to claim 1, said machine further comprising a wire cutting tool provided at the spring forming station for separating a finished coiled spring from the remainder of the wire in response to an actuation of operating means for said cutting tool, wherein an adjustable limit switch is provided for stopping the gear rack and the cam curve and actuating the operating means for the cutting tool when the gear rack and the cam curve reach a predetermined position.

5. A spring coiling machine according to claim 4, wherein means are provided to initiate a return stroke of the gear rack and the cam curve in response to each cutting operation.

6. A spring coiling machine according to claim 1, said machine further comprising a rectilinearly movable distributor adapted to facilitate a distribution of springs produced in the machine to different usage stations.

7. A spring coiling machine according to claim 6, wherein said distributor comprises a plurality of reception chambers which are adapted to be placed one upon the other in front of the spring forming station to receive springs there produced in successive chambers, from which the springs may be discharged to desired usage stations.

8. A spring coiling machine according to claim 7, wherein the distributor is controlled by the movement of the gear rack and the cam curve to place a new reception chamber in front of the spring forming station once during each working cycle of the gear rack and the cam curve.

9. A spring coiling machine, said machine comprising two cooperating rotatable wire feeding rollers, a driving device for said wire feeding rollers by which said rollers may be rotated in order to feed a wire in its longitudinal direction between said rollers, a spring forming station where wire bending tools are provided to cause the wire, as it reaches said station, to be successively bent so as to form a coiled spring by being brought into contact with successive portions of said bending tools, a movable pitch controlling tool to control the pitch of said coiled spring along the length thereof through engagement with said wire, a movable cam curve, a cam follower connected to said pitch controlling tool to control the position thereof through cooperation with said movable cam curve, a reciprocating gear rack arranged for reciprocating rectilinear movement in unison with said cam curve, said driving device including a pressure fluid operated working cylinder, wherein said wire feeding rollers and said gear rack and cam curve are driven by said pressure fluid operated working cylinder.

10. A spring coiling machine, comprising two cooperating rotatable wire feeding rollers and a driving device including a pressure fluid operated working cylinder for said wire feeding rollers by which said rollers may be rotated in order to feed a wire in its longitudinal direction between said rollers to a spring forming station, where wire bending tools are provided to cause the wire, as it reaches said station, to be successively bent so as to form a coiled spring by being brought into contact with said bending tools with successive portions thereof, and where a separate movable pitch controlling tool is provided to control the pitch of said spring along the length thereof through engagement with said wire, a cam follower being connected to said pitch controlling tool to control the position thereof through cooperation with a movable cam curve operatively connected to said driving device, wherein said cam curve is arranged for reciprocating rectilinear movement in unison with a reciprocating gear rack included in said driving device and wherein said gear rack and said cam curve are mounted on a common slidable carrier and are adapted to be driven by said driving device, a wire cutting tool provided at the spring forming station for separating a finished coiled spring from the remainder of the wire in response to an actuation of operating means for said cutting tool, wherein an adjustable limit switch is provided for stopping the gear rack and the cam curve and actuating the operating means for the cutting tool when the gear rack and the cam curve reach a predetermined position, means to initiate a return stroke of the gear rack and the cam curve in response to each cutting operation, and a distributor adapted to facilitate a distribution of springs produced in the machine to different usage stations.

* * * * *